US007492056B2

(12) United States Patent
Koutsandreas et al.

(10) Patent No.: US 7,492,056 B2
(45) Date of Patent: Feb. 17, 2009

(54) ELECTRICAL LOCKING SYSTEM

(75) Inventors: Panagiotis Koutsandreas, Vienna (AT); Ludwik Waskiewicz, Vösendorf (AT)

(73) Assignee: Siemens AG, Munich (DE)

( * ) Notice: Subject to any disclaimer, the term of this patent is extended or adjusted under 35 U.S.C. 154(b) by 477 days.

(21) Appl. No.: 11/198,100

(22) Filed: Aug. 5, 2005

(65) Prior Publication Data

US 2006/0028068 A1 Feb. 9, 2006

(30) Foreign Application Priority Data

Aug. 5, 2004 (DE) ..... 10 2004 038 119

(51) Int. Cl.
*H01H 47/22* (2006.01)

(52) U.S. Cl. ..... 307/10.2

(58) Field of Classification Search ..... 307/10.1, 307/10.2

See application file for complete search history.

(56) References Cited

U.S. PATENT DOCUMENTS

| | | | | |
|---|---|---|---|---|
| 4,572,320 | A * | 2/1986 | Robbins, Jr. | 180/289 |
| 5,042,932 | A * | 8/1991 | Pent | 359/874 |
| 5,781,047 | A * | 7/1998 | Shreve et al. | 327/110 |
| 5,990,573 | A * | 11/1999 | Granitz et al. | 307/10.1 |
| 6,369,458 | B2 | 4/2002 | Zintler et al. | |
| 6,744,147 | B2 * | 6/2004 | Taniguchi et al. | 307/10.1 |
| 7,250,693 | B2 * | 7/2007 | Hayashi et al. | 307/10.2 |
| 2001/0010601 | A1 * | 8/2001 | Schnell et al. | 359/877 |
| 2002/0000755 | A1 | 1/2002 | Zintler | |

FOREIGN PATENT DOCUMENTS

| | | | |
|---|---|---|---|
| DE | 37 03 590 | C1 | 7/1988 |
| DE | 195 48 612 | A1 | 6/1997 |
| DE | 198 22 887 | A1 | 12/1999 |
| DE | 100 43 821 | A1 | 3/2002 |
| DE | 102 26 252 | A1 | 1/2004 |
| EP | 1 186 488 | A2 | 3/2002 |

OTHER PUBLICATIONS

DE10226252 01/20047 German to English Machine translation.*

* cited by examiner

*Primary Examiner*—Michael J Sherry
*Assistant Examiner*—Michael Rutland Wallis
(74) *Attorney, Agent, or Firm*—Laurence A. Greenberg; Werner H. Stemer; Ralph E. Locher

(57) ABSTRACT

In an electric locking system, a controllable switching device is disposed in connection cables between the driver module for triggering an electric motor of a central locking system and a supply voltage. The controllable switching device is opened in a standby mode and thus interrupts the supply voltage to the driver module. Therefore, an introduction of an external voltage in order to trigger the electric motors no longer has any affect whatsoever on the driver module, so that in this case the driver module does not trigger the electric motors with the result that unwanted manipulation is prevented.

15 Claims, 5 Drawing Sheets

ELECTRICAL LOCKING SYSTEM

BACKGROUND OF THE INVENTION

Field of the Invention

The invention relates to an electric locking system, particularly for a motor vehicle, having a driver circuit, to which a supply potential may be applied on the supply side, via at least one connection cable. At least one electrically controlled locking mechanism for the mechanical locking and unlocking of a door or flap is provided and which is connected—for control purposes—via at least one control cable to output terminals of a driver circuit. The invention further relates to a mirror module in a motor vehicle and to a method for operating a locking system or mirror module.

Even though it may be applied to any electric locking system in principle, the invention and the problem on which it is based are described below with reference to an electronic locking system in the motor vehicle, and—in particular—on the basis of a central locking system.

Such electrical and electronic locking systems are generally known in a great many different embodiments, and therefore their construction and mode of operation are not described in greater detail below. By way of general background information, reference is made only to German patent DE 37 03 590 C1, in which a circuit configuration for triggering an electric motor of a central locking system is described.

Until now, the elements of a central locking system, namely the driver module, the electric motor and the connection cables between the electric motor and the driver module, have been integrated in the door lining area, so that this component could not be externally manipulated due to the fact that access to it from the exterior was impossible or extremely difficult. As a result of the ever-present tendency—particularly in the automotive industry—of providing the most cost-effective solutions, some components in the vehicle have a joint use. In the case of a central locking system, control cables for triggering the electric motor of the central locking system and the corresponding power supply cables to the car battery are sometimes also used for triggering an electric motor for adjusting the external vehicle mirrors. This has an advantage in manufacturing terms, since the relevant cables can be bundled. It also results in that fewer supply cables are needed since the same supply cables to the car battery can be used for the electric motors of the central locking system and of the side mirror.

This results in that some jointly used supply cables run through the area of the side mirror, and this can cause problems. By forcing open the housing of the side mirror, it is possible to manipulate the central locking system. This possibility of manipulation is illustrated with the help of the circuit diagram in FIG. 5.

The circuit configuration in FIG. 5 shows a driver module C, that is connected on a supply side to supply terminals A, B, between which a battery voltage VBAT is provided. The driver module C, in a known method, has two driver stages with a total of four MOSFETs C1-C4. An electric motor D is also present, for example for the central locking system. The electric motor D is connected to corresponding output terminals on the driver module C. The electric motor D can be manipulated by applying an externally injected voltage at a terminal labeled F, which is located externally between the driver module C and electric motor D. This has been indicated by the switch E in FIG. 1. In this way the electric motor D can have either the 24V (potential position P1) or the −12V potential (position P2) applied to it.

For example, if a negative voltage with an absolute value greater than the flow voltage of the free-wheeling diode of the MOSFET C4 is injected at the externally accessible cables of the electric motor D (externally located pin F), this causes the destruction of the free-wheeling diode. Thus the electric motor D is operated via the free-wheeling diode of the MOSFET C2, but only if the externally applied voltage is negative to such an extent that the electric motor D can run. In order to operate the electric motor D in the reverse direction of rotation, it is necessary for a voltage that is greater than the battery voltage VBAT plus the flow voltage of the free-wheeling diode of the MOSFET C3 to be injected at the externally accessible pin F. This causes the destruction of said free-wheeling diode. Thus the electric motor D is operated via the freewheeling diode of the MOSFET C1, but only if the externally applied voltage is so great that the electric motor D can rotate.

In this way, by applying a suitably selected external potential at the externally located pin F, it is possible to manipulate the electric motor D of the central locking system. This is a situation that naturally needs to be prevented.

SUMMARY OF THE INVENTION

It is accordingly an object of the invention to provide an electrical locking system which overcomes the above-mentioned disadvantages of the prior art devices and methods of this general type, which prevents the possibility of manipulation in a generic electric locking system.

With the foregoing and other objects in view there is provided, in accordance with the invention, an electric locking system. The locking system contains at least one connection cable and a driver circuit having a supply side receiving a supply potential through the connection cable connected to the driver circuit. The driver circuit further has output terminals. A control cable is connected to the output terminals. At least one electrically controlled locking mechanism for mechanical locking and unlocking a door or flap is provided. The locking mechanism is connected, for control purposes, through the control cable to the output terminals of the driver circuit. A controllable switching device is connected to the connection cable. The controllable switching device interrupts the connection cable when the electric locking system is in an idle mode.

The idea on which the invention is based consists in the configuration of at least one controllable switching device in the connection cables between the driver module for triggering the electric motor of the central locking system and the supply voltage. When the motor vehicle is parked and/or locked, the driver module is in standby mode. In this operating mode the controllable switches of the switching device are controlled at high resistance and therefore interrupt the supply and/or chassis grounding cable from the driver module to the supply terminals. The driver module is therefore no longer supplied with a supply voltage when in the standby mode. The advantageous effect of this is that the introduction of an external voltage in order to trigger the electric motors no longer has any effect whatsoever on the driver module, so that the driver module no longer triggers the electric motors with a supply potential in this case. Even though the application of an external voltage to the electric motors or to the connection cables between the electric motor and the driver module is still possible during a manipulation attempt, the locking mechanism containing the electric motor and the mechanical lock are not activated, so that any manipulation of the electric motors resulting in the unwanted unlocking of the central locking system is completely prevented.

The measures according to the invention prevent the functionally inappropriate revolutions of the electric motor and also protect the driver stages of the driver module against destruction, for example as a result of intrusion, unauthorized repair to the mirror, etc.

In the case of a mirror module, the casing of which contains at least parts of the control cables of the central locking system, cost advantages can be realized by the bundling and use of joint switching resources. Furthermore, this solution is also altogether very safe since it does not have the disadvantage of being able to be manipulated by the introduction of an external voltage via the mirror housing.

In an advantageous embodiment, a first adjustment device is provided for adjusting a mirror on a motor vehicle. The adjustment device may be configured as an electric motor, for example. The first adjustment device is connected, for control purposes, to the same driver circuit that is also used for triggering a second adjustment device of the locking system, and is therefore operated by the same driver module of the electric locking system. The joint use of a single driver module for both the electric locking system and the adjustment device results in cost advantages.

In an advantageous development the controllable switching device has at least one controllable switch, which is disposed—with its controlled section—in at least one of the connection cables. Such a controllable switch—which, for example, many be configured as a bipolar transistor or as a MOSFET—is disposed, in the case of a MOSFET, with its drain-source load section between a supply input on the driver circuit and a supply terminal. At least one controllable switch is preferably provided in each connection cable of the driver module to the supply terminals.

In a highly advantageous embodiment, the controllable switching device is disposed in an area of the locking system or mirror module that is inaccessible from the exterior. In this way, it is additionally possible to prevent manipulation being effected by short-circuiting of the controllable switching device according to the invention. An example of such an area that is difficult or impossible to access from the exterior, in the case of an electrical locking system for a motor vehicle, is in the area of the door lining.

In a likewise highly advantageous embodiment, the controllable switching device, the driver circuit and a control circuit for triggering the controllable switching device and the driver circuit are integrated on the same semiconductor chip. Not only is this a highly cost-effective way of providing the functionality according to the invention, it also prevents more or less any manipulation of the controllable switching device itself since the switching device is disposed inside a housing of a semiconductor chip and is therefore inaccessible from the exterior.

The controllable switching device as well as the driver circuit are each triggered via control units provided especially for this purpose. In a highly advantageous embodiment, a single control unit is used here for controlling the controllable switching device as well as the driver circuit.

In an alternative embodiment, the control unit is a component of a control device. The control device may—for example—be the control device for an access and/or driver authorization system of a motor vehicle. Alternatively, a different control device may also be used here—for example the engine control device, or the control device for the mirror adjustment, etc.

In a typical embodiment, the driver circuit is configured as a full bridge circuit or half bridge circuit. The driver circuit in this case may be configured as single-level or multilevel. The elements of the driver circuit are typically configured as MOSFETs, which have an integrated free-wheeling diode. If an unwanted external voltage is introduced, the unwanted destruction of the free-wheeling diodes of the MOSFETs and thus destruction of the driver stages is prevented by the controllable switching device according to the invention. Thus a reverse voltage protection of the MOSFETS in the driver circuit is also more or less guaranteed at the same time, and this prevents the free-wheeling diodes of the MOSFETs in the driver module from being destroyed by the unauthorized introduction of an external voltage.

In an embodiment of the method according to the invention, the first operating mode, in which the driver module is disconnected—on the supply side—from at least one supply potential via the controllable switching device, signifies an idle mode. To a certain extent, therefore, the idle mode represents a standby mode in which the central locking system is locked. The second operating mode—in which the driver module has at least one supply potential applied to it via the controllable switching device—signifies a normal mode in which the locking system is unlocked. The second operating mode can also signify a locked status, if—for example—the locking system is locked for safety reasons while the motor vehicle is in motion.

Other features which are considered as characteristic for the invention are set forth in the appended claims.

Although the invention is illustrated and described herein as embodied in an electrical locking system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
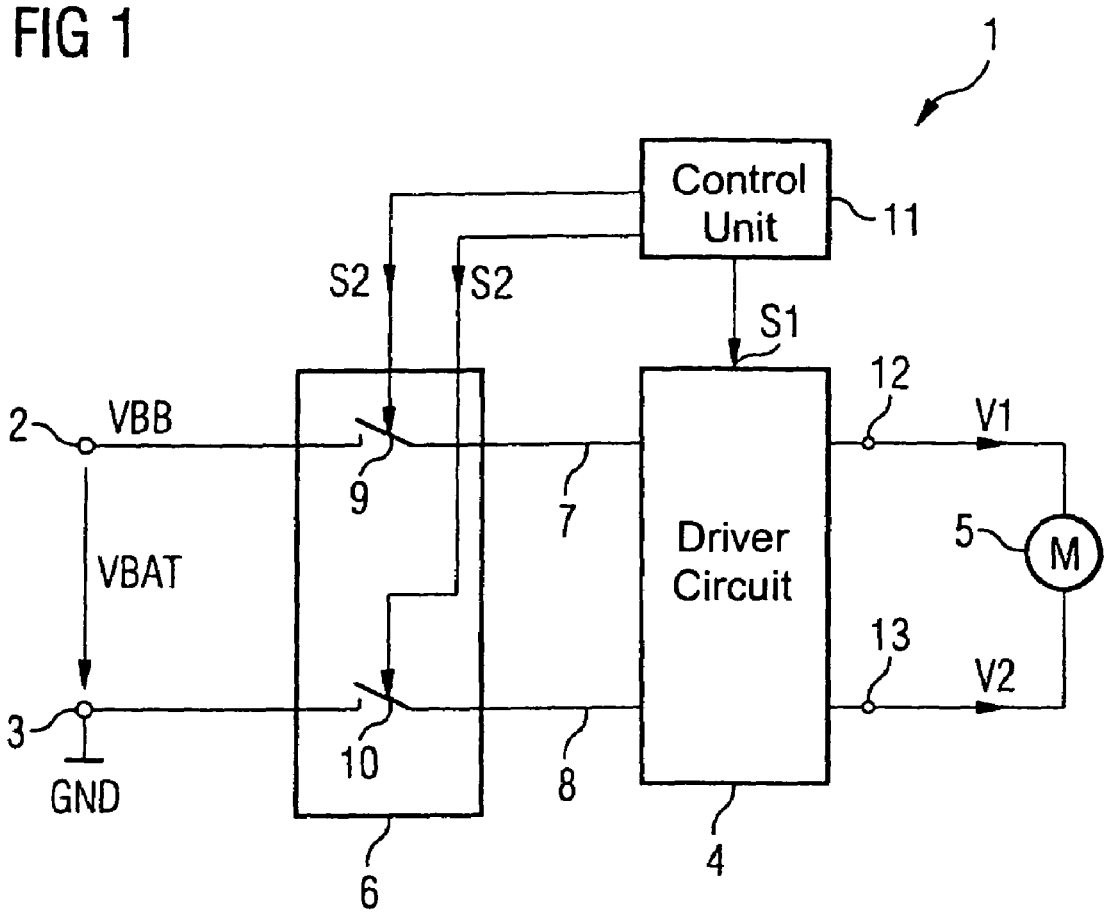
FIG. 1 is a block circuit diagram showing a general view of an electric locking system according to the invention.

In all the figures of the drawing, sub-features and integral parts that correspond to one another bear the same reference symbol in each case. Referring now to the figures of the drawing in detail and first, particularly, to FIG. 1 thereof, there is shown a block circuit diagram of the basic construction of an electric locking system 1 configured according to the invention. The locking system 1 has two supply terminals 2, 3 on a supply side, between which a battery voltage VBAT is applied. The first supply terminal 2 has a first supply potential VBB, in this case a positive battery potential VBB, applied to it. The second supply terminal 3 has a second supply potential GND, in this case the potential of the ground reference GND, applied to it.

Furthermore, a driver circuit 4 is provided, which can be connected to the supply terminals 2, 3, on the supply side, via connection cables 7, 8. The driver circuit 4 is connected on the output side to an electric motor 5 in order to lock and unlock a non-illustrated locking device. In order to operate the electric motor 5 the driver circuit 4 provides control potentials V1, V2 on an output side, whereby a rotational speed and direction of the electric motor 5 can be adjusted via the sign and amount of the potentials V1, V2 in a manner that is known per se.

According to the invention, a controllable switching device 6 is disposed between the supply terminals 2, 3 and the supply inputs of the driver circuit 4. The switching device 6 contains two controllable switches 9, 10, which are disposed in the connection cables 7, 8. A control unit 11 is provided for controlling the switching device 6 and/or the controllable switches 9, 10 and the driver circuit 4. The control unit 11 generates first control signals S1 for triggering the driver circuit 4 and second control signals S2, S3 for controlling the controllable switching device 6 and/or its switches 9, 10.

Figure 2:
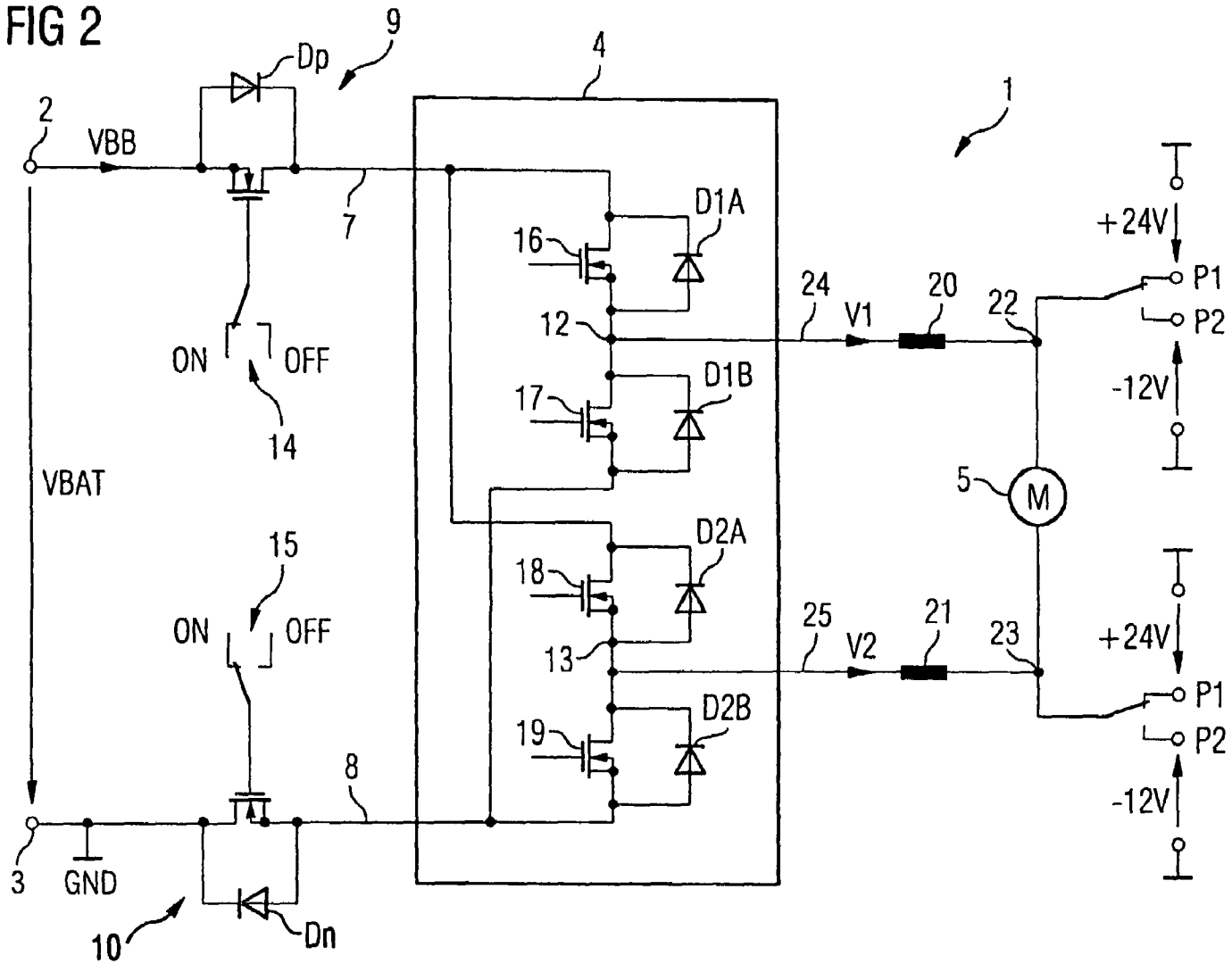
FIG. 2 is a circuit diagram of a first exemplary embodiment of the locking system according to the invention.

FIG. 2 uses a circuit diagram to show a first exemplary embodiment of the locking system 1 according to the invention, from FIG. 1. The controllable switches 9, 10 are configured here as MOSFETs. The p-channel MOSFET 9 has a free-wheeling diode Dp. The n-channel MOSFET 10 has a free-wheeling diode Dn. In contrast to FIG. 1, in FIG. 2 the control unit 11 for triggering the controllable switches 9, 10 is not shown; only its function is illustrated by the on/off switches 14, 15.

The driver circuit 4 contains a total of four MOSFETs 16-19, each of which has a free-wheeling diode D1A, D1B, D2A, D2B. The MOSFETs 16, 17 are disposed with regard to their controlled sections in sequence to one another and between the supply cables 7, 8. A tapping 12 between the two MOSFETs 16, 17 forms the output 12 of the driver circuit 4. In the same way the MOSFETs 18, 19 are also disposed with regard to their controlled sections in sequence to one another and between the supply cables 7, 8, with a tapping 13 between the MOSFETs 18, 19 forming a second output 13 for the driver circuit 4. An impedance 20, 21 is provided in connection cables 24, 25 between one output 12, 13 and a corresponding terminal of the electric motor 5. In addition, an externally accessible node 22, 23, which is connected to a terminal of the electric motor 5, is shown for each of these. A first operating potential (position P1, 24V) or a second operating potential (position P2, −12V) may be applied to the respective terminals of the electric motor 5 via the nodes 22, 23.

Figure 3:
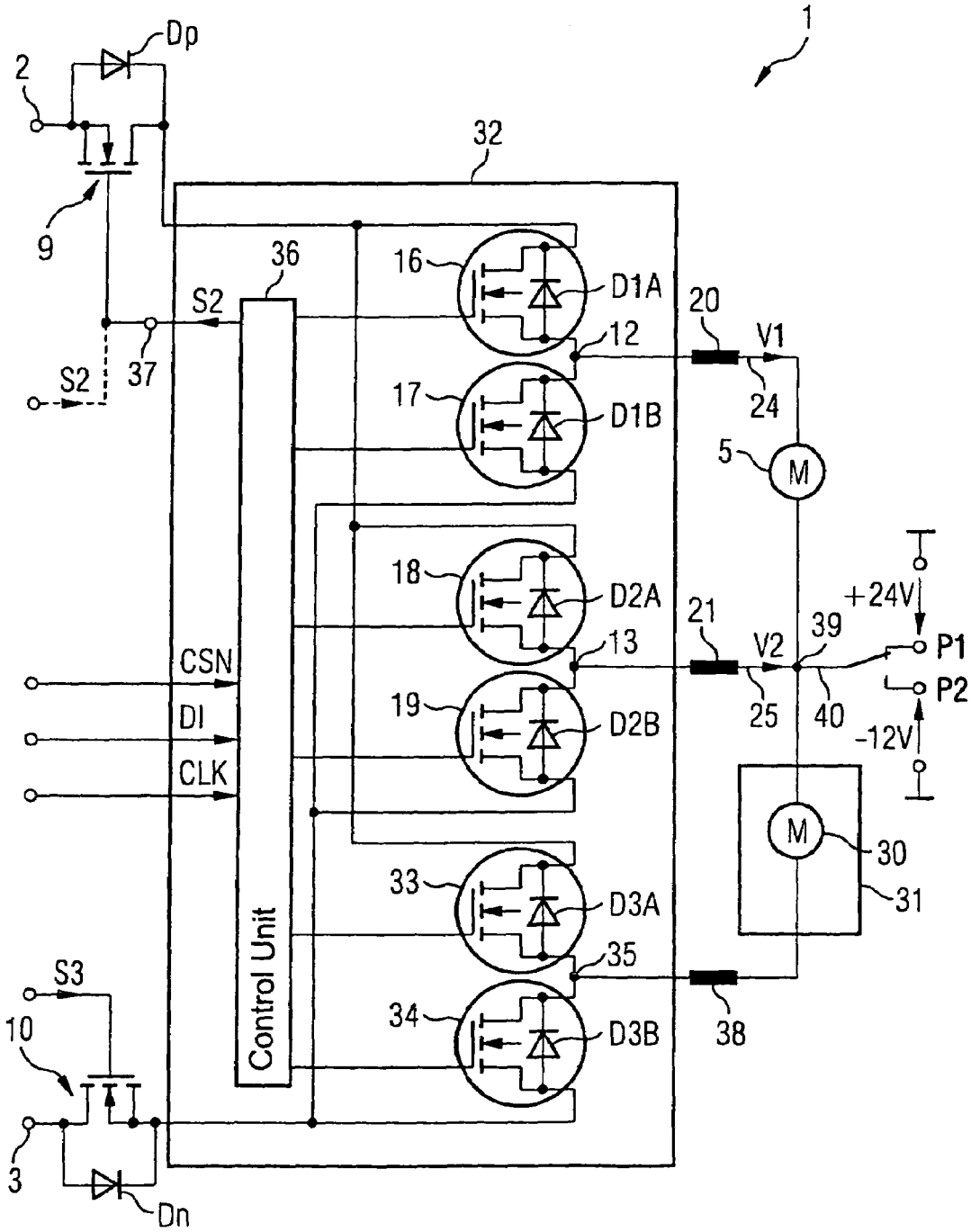
FIG. 3 is a circuit diagram of a second exemplary embodiment of a locking system according to the invention.

FIG. 3 is a circuit diagram of a second, preferred exemplary embodiment of the locking system 1 according to the invention. In contrast to the first exemplary embodiment in FIG. 2, a further electric motor 30 is provided in addition to the electric motor 5 for locking the electric locking system 1. The second electric motor 30 is used for electrical adjustment of a non-illustrated mirror. The second electric motor 30 is disposed for this purpose in a mirror housing 31 (schematically indicated only).

The electric motor 30 as well as the electric motor 5 are controlled via a joint driver module 32, which therefore contains the driver module 4 for triggering the first electric motor 5 and a driver module for triggering the second electric motor 30. Two additional transistors 33, 34, which have corresponding free-wheeling diodes D3A, D3B, are provided in addition to the transistors 16-19 for this purpose. The two transistors 33, 34 are accordingly disposed in relation to their controlled sections in sequence to one another and between the supply cables 7, 8. A tapping 35 between the two transistors 33, 34 forms a third output 35 of the driver module 32. The second electric motor 30 is connected to corresponding outputs 13, 35 in the driver circuit 32 via respective impedances 21, 38. The two electric motors 5, 30 therefore use at least some of the same resources of the driver circuit 32 and are linked together for this purpose via a common node 39. The node 39 can have an externally injectable potential (+24 V, −12 V) applied to it via a connection cable 40.

A control unit 36 is provided for triggering the control terminals of the MOSFETs 16-19, 33, 34, the control unit here forming part of the driver module 32. A clock signal CLK and data and/or control signals CSN, DI can be fed to the control unit 36 on the input side. The control unit 36 also has a control output 37 via which a load pump control signal S2 can be applied to the control input of the MOSFET 9. The MOSFET 9 can also be triggered via an external terminal with the control signal S2; this is indicated by the dotted line FIG. 3. The control input of the MOSFET 10 can be controlled via an externally provided control signal S3.

The functioning of the inventive controllable switching device 6 in the electric locking system is explained in greater detail below on the basis of FIG. 3.

To prevent the consequences of any unwanted manipulation to the reference potential GND at the externally accessible connection cable 40, according to the invention the ground connection of the supply voltage to the driver circuit 32 is interrupted when the electric locking system 1 is in standby mode. For this purpose the MOSFET 10 has a control signal S3 applied to it for control reasons. The control signal S3 may, for example, be injected externally and, for example, may be provided via a program-controlled device such as a microprocessor. As a result of this the MOSFET 10 becomes high-resistance, with the result that the driver circuit 32 now no longer has the reference potential GND applied to it on the input side. If a negative voltage, the absolute value of which is greater than the flow voltage of the diode D2B, is now injected into the externally accessible connection cable 40, then this no longer causes the destruction of the diode D2B. The driver circuit 32—and, in particular, the MOSFET 19—therefore remain active. All electric motors 5, 30—and, in particular, the electric motor 5 for locking and unlocking the electric locking system, can therefore no longer be operated via the two diodes D1B, D3B. Unwanted unlocking of the locking device is thereby prevented.

To prevent the consequences of any unwanted manipulation to the positive supply potential VBB at the externally accessible connection cable 40, according to the invention the connection cable 7 between the supply terminal 2 and the driver circuit 32 is interrupted by the MOSFET 9 when the electric locking system 1 is in the standby mode. This is affected by control signal 82, which is provided by the control unit 36 of the driver circuit 32. If a voltage that is greater than the battery voltage VBAT plus the flow voltage of the diode D2A is now injected into the externally accessible connection cable 40, then this no longer causes the destruction of the diode D2A. The electric motors 5, 30 can therefore likewise no longer be operated via the diodes D1A, D3A, so that any unlocking of the locking mechanism is completely prevented.

Figure 4:
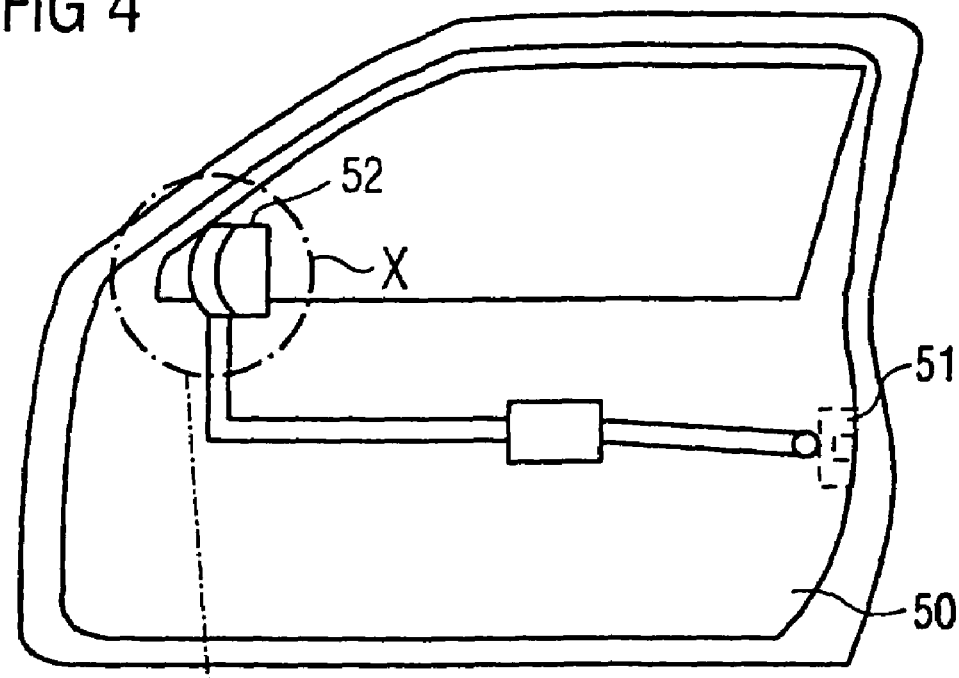
FIG. 4 is a schematic illustration of a motor vehicle door with a locking system and mirror module according to the invention.

FIG. 4 shows a schematic illustration of a motor vehicle door with the electric locking system and the mirror module according to the invention. The motor vehicle door is labeled 50 in FIG. 4. The door has mechanical locking elements, in particular a latch and a pawl, in a locking unit 51. The locking unit 51 is well protected by its disposition inside the vehicle door 50. In order to open and close the locking elements of the locking unit 3, the electric motor 5 is mechanically connected to these elements. Furthermore, a mirror module 52 is disposed in the door area.

Figure 4A:
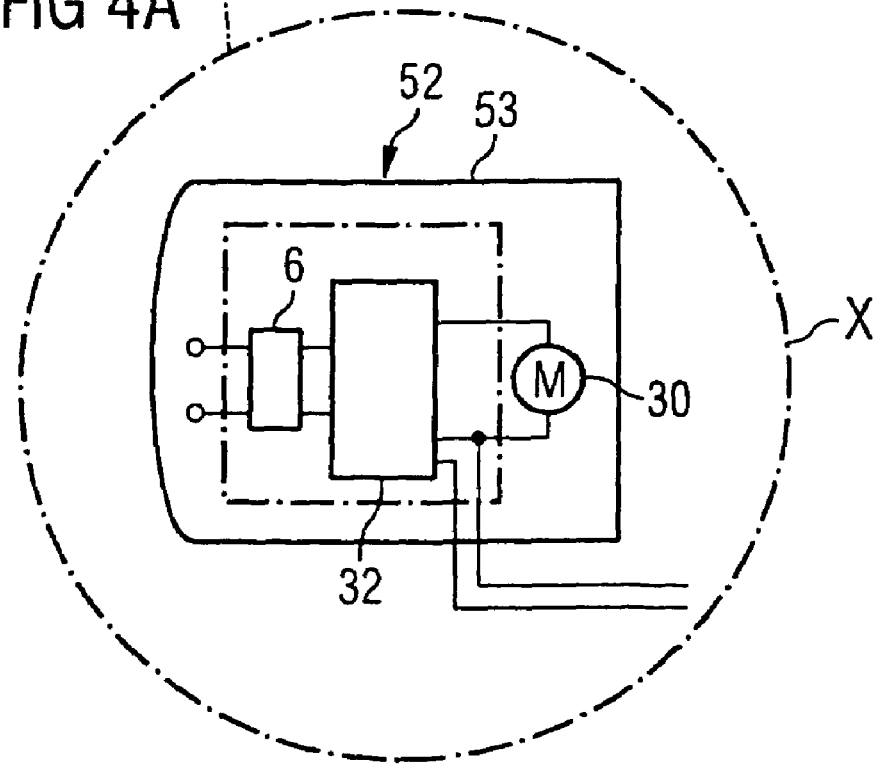
FIG. 4A is an illustration of a detailed view of the mirror module shown in FIG. 4.
Figure 5:
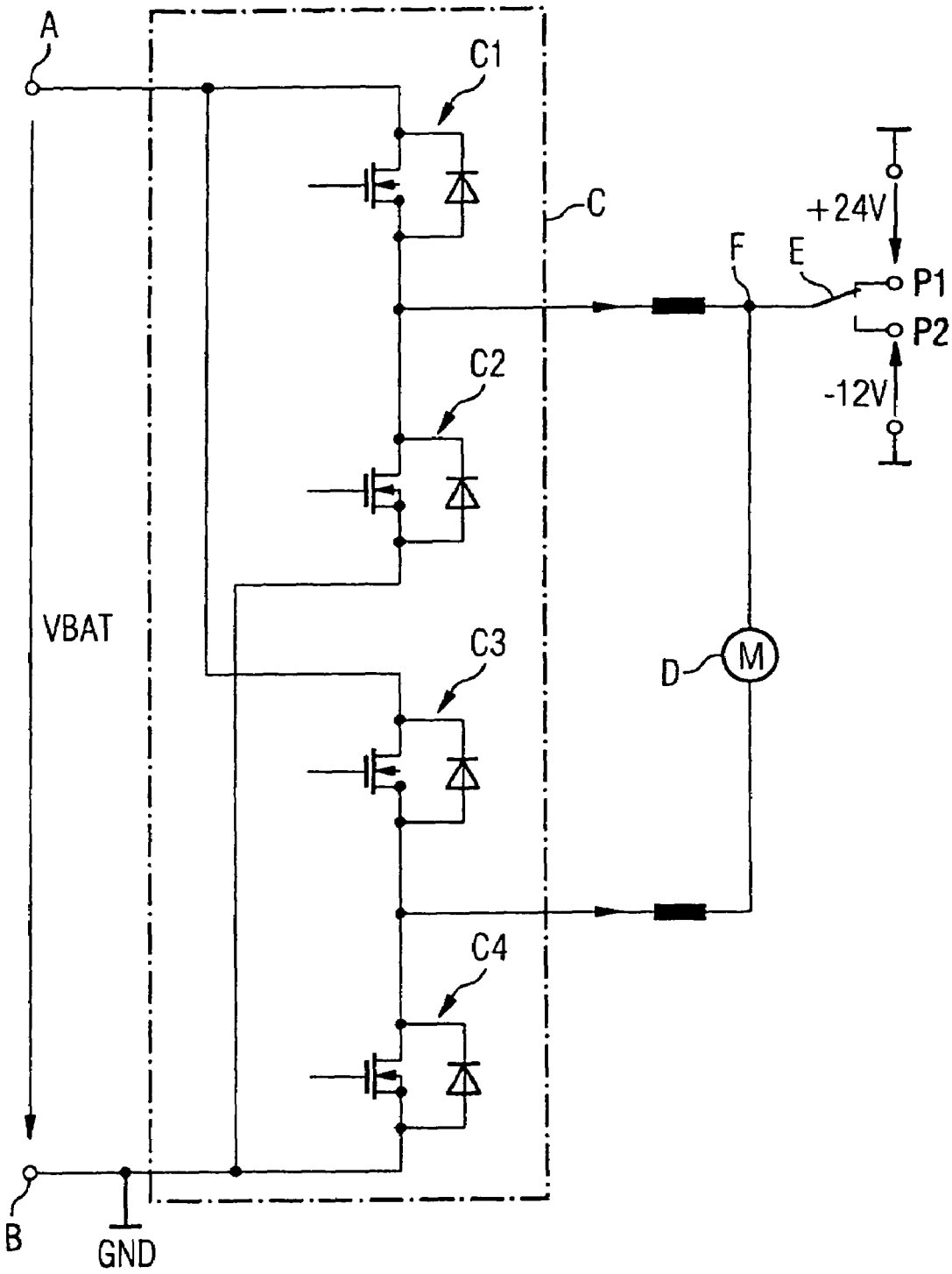
FIG 5 Prior Art
FIG. 5 is a known circuit configuration for an electric lock-ing system with mirror module.

FIG. 4A shows a detailed illustration X of the mirror module 52. In a known method, the mirror module 52 has a mirror housing 53 with a non-illustrated mirror. The mirror can be adjusted via the second electric motor 30. Both the second electric motor 30 and the joint driver circuit 32 are disposed in the mirror module 52 or within the mirror housing 53. To prevent manipulation, the mirror module 52 also contains the controllable switching device 6 according to the invention. The controllable switching device 6 is preferably disposed, together with the driver circuit 32, in a joint module that is indicated in FIG. 4A by a dotted outline. It would also be possible and preferable for the driver module 32 to be disposed in an area of the door lining that is protected and inaccessible from the exterior.

Even though this invention has been described on the basis of a preferred exemplary embodiment, it is not restricted to that embodiment but can be modified in a great many ways. For example, the invention is not limited to an electric locking system configured as a central locking system, but may be used to advantage in all electric locking systems that are to be protected by manipulation. The invention is also particularly suitable for use in remote-controlled locking systems.

The term electric locking system for a motor vehicle door lock is comprehensively defined. Here, it does not just mean the side and rear door locks of the motor vehicle, but also—for example—the tailgate locks, fuel tank cover locks, hood locks, etc. Furthermore, the term electric locking system for a motor vehicle door lock and/or the term mirror module refers to the whole system, the components of which may also, of course, be disposed separately.

Furthermore, in these exemplary embodiments, a circuit configuration for the electrical locking system according to the invention is illustrated merely by way of example. The individual elements of the circuit configuration and—in particular—the driver circuit, the control circuit, and the controllable switches and MOSFETs, etc. that are used, may of course be modified, adjusted or replaced as required. In particular, other transistors may also be used instead of MOSFETs for the controllable switching device and/or the driver circuit. Furthermore, by replacing the conductivity types n with p and vice versa, any number of additional circuit variations may be obtained without essentially deviating from the basic principle of the invention.

This application claims the priority, under 35 U.S.C. § 119, of German patent application No. 10 2004 0386 119.4, filed Aug. 5, 2004; the entire disclosure of the prior application is herewith incorporated by reference.

We claim:

1. An electric locking system, comprising:

at least one connection cable;

a driver circuit having a supply side receiving a supply potential through said connection cable connected to said driver circuit, said driver circuit further having output terminals;

a control cable connected to said output terminals;

at least one electrically controlled locking mechanism for mechanical locking and unlocking a door or flap, said locking mechanism connected, for control purposes, through said control cable to said output terminals of said driver circuit; and a controllable switching device connected to said connection cable, said controllable switching device configured to disconnect said driver circuit from the supply potential by interrupting said connection cable when the electric locking system is in an idle mode, said controllable switching device configured to disconnect said driver circuit from a further supply potential when the electric locking system is in the idle mode.

2. The locking system according to claim 1, further comprising a first adjustment device for adjusting a mirror of a motor vehicle, said first adjustment device connected to said driver circuit for control purposes.

3. The locking system according to claim 1, wherein said controllable switching device has at least one controllable switch with a controlled section disposed in said connection cable.

4. The locking system according to claim 3, wherein said controllable switching device is disposed in an area of the locking system that is inaccessible from an exterior of a motor vehicle.

5. The locking system according to claim 3, further comprising a control circuit connected to and triggering said controllable switching device and said driver circuit, said controllable switching device, said driver circuit and said control circuit are integrated on a same semiconductor chip.

6. The locking system according to claim 5, wherein said control circuit is a single control unit for controlling said controllable switching device and said driver circuit.

7. The locking system according to claim 6, wherein said control unit is configured as a control device for an access and/or a driver authorization system of a motor vehicle.

8. The locking system according to claim 1, wherein said driver circuit has a plurality of MOSFETs.

9. A mirror module of a motor vehicle, the mirror module comprising:

at least one connection cable;

a driver circuit having a supply side receiving at least one supply potential through said connection cable connected to said supply side, said driver circuit further having output terminals;

a first adjustment device;

an electrical locking system having a control cable connected to said output terminals of said driver circuit;

a second controllable adjustment device for adjusting said electrical locking system;

said control cable being connected to said output terminals of said driver circuit and through said control cable, said second controllable adjustment device for adjusting said electric locking system may be triggered;

a mirror housing for accommodating a mirror being adjusted by said first adjustment device, said mirror housing having disposed within it at least part of said control cable; and a controllable switching device connected to said connection cable, said controllable switching device configured to disconnect said driver circuit from the supply potential by interrupting said connection cable, and said controllable switching device configured to disconnect said driver circuit from a further supply potential.

10. The mirror module according to claim 9, wherein said controllable switching device has at least one controllable switch with a controlled section disposed in said connection cable.

11. The mirror module according to claim 10, wherein said controllable switching device is disposed in an area of the mirror module that is inaccessible from an exterior of the motor vehicle.

12. The mirror module according to claim 10, further comprising a control circuit connected to and triggering said controllable switching device and said driver circuit, said controllable switching device, said driver circuit and said control circuit are integrated on a same semiconductor chip.

13. The mirror module according to claim 12, wherein said control circuit is a single control unit for controlling said controllable switching device and said driver circuit.

14. The mirror module according to claim 13, wherein said control unit is configured as a control device for an access and/or a driver authorization system of the motor vehicle.

15. The mirror module according to claim 9, wherein said driver circuit has a plurality of MOSFETs.

* * * * *